US007874594B2

(12) United States Patent
Flynn et al.

(10) Patent No.: US 7,874,594 B2
(45) Date of Patent: Jan. 25, 2011

(54) LABEL ADHERABLE TO AN OBJECT AND METHOD FOR MAKING

(75) Inventors: Patrick J. Flynn, Redlands, CA (US); Timothy J. Flynn, Key Largo, FL (US)

(73) Assignee: Continental Datalabel, Inc., Elgin, IL (US)

( * ) Notice: Subject to any disclaimer, the term of this patent is extended or adjusted under 35 U.S.C. 154(b) by 367 days.

(21) Appl. No.: 11/585,783

(22) Filed: Oct. 24, 2006

(65) Prior Publication Data

US 2008/0093840 A1 Apr. 24, 2008

(51) Int. Cl.
*B42D 15/00* (2006.01)

(52) U.S. Cl. ..... 283/81; 283/101

(58) Field of Classification Search ..... 283/73, 283/74, 81, 98, 100, 101; 428/40.1, 42.1–42.3
See application file for complete search history.

(56) References Cited

U.S. PATENT DOCUMENTS 4,231,833 A * 11/1980 Lieberman ..... 428/41.8
6,461,708 B1 * 10/2002 Dronzek ..... 428/40.1
6,869,654 B2 * 3/2005 Ginkel et al. ..... 428/40.1
7,475,912 B1 * 1/2009 Reffett ..... 283/81
2006/0037507 A1 * 2/2006 Trigg et al. ..... 101/483
2006/0062953 A1 * 3/2006 Trigg et al. ..... 428/40.1
2006/0233994 A1 * 10/2006 Hodsdon et al. ..... 428/40.1

FOREIGN PATENT DOCUMENTS

JP 2000162744 A * 6/2000

* cited by examiner

*Primary Examiner*—Dana Ross
*Assistant Examiner*—Pradeep C Battula
(74) *Attorney, Agent, or Firm*—Pauley Petersen & Erickson

(57) ABSTRACT

A label assembly including a carrier sheet and label sheets, including a first sheet and a second sheet and defining at least one label portion. The label portion is adhesively bonded to the carrier sheet and removable with respect to the carrier sheet. A label comprises a first sheet having a first outer periphery and a second sheet having a second outer periphery. The first outer periphery may be coextensive with the second outer periphery. At least a portion of the first sheet is adhesively bonded to the second sheet by a first adhesive. The label further includes a second adhesive at least partially covering a back surface of the label. When the label is in a mounted position with respect to an object, the second adhesive contacts a surface of the object. Voids and/or openings within the label, or any part thereof, may be aligned with or over certain areas on a surface of an object to allow visual and/or physical access to such areas on the surface of the object.

13 Claims, 5 Drawing Sheets

LABEL ADHERABLE TO AN OBJECT AND METHOD FOR MAKING

BACKGROUND OF THE INVENTION

1. Field of the Invention

This invention is directed to a label with a printable surface and that is adherable to a surface of an object. More particularly, this invention is directed to a label that is customizable to cover at least one surface of a three dimensional object while allowing for visual and/or physical access to at least one area on the surface of the object. This invention is further directed to a label assembly including a carrier sheet and at least one label. This invention is still further directed to a method for making a label.

2. Description of Related Art

Personal media devices and/or personal electronic devices, such as, for example, IPOD™ players, MP3 players, cell phones, calculators and/or other devices, often include LCD screens and/or other surfaces that can be easily scratched or otherwise damaged. Surfaces of many such devices often retain fingerprints and/or other undesirable marks upon handling. Surfaces of most conventional personal electronic devices and/or personal media devices are not normally customizable to include a choice of an image or information.

A need exists for a label that can be mounted to, positioned on or adhered to a surface of an object to protect the surface of the object. A need also exists for a label having a printable surface to print a choice of an image or information. A need exists for a label assembly that can be manufactured and assembled to form a label having a printable surface and adherable to at least one surface of an object. A further need exists for a label that can be customized and assembled on an object by the user.

SUMMARY OF THE INVENTION

It is an object of this invention to provide a label that can be mounted or adhered about an object, such as a three dimensional or multi-surfaced object, to protect at least one surface of the object.

It is a further object of this invention to provide a label having at least one printable surface and/or a printable coating for printing selected design and/or other information.

It is still a further object of this invention to provide a transparent or translucent label or label portion to allow visual access to various areas on an object, such as when the label is mounted on or adhered to the object.

It is yet a further object of this invention to provide a label having voids or openings to accommodate various characteristics of an object, such as, for example, control panels or monitors, and/or to allow physical access to various characteristics of the object.

The above and other objects of this invention can be attained with a label including a first sheet having a first outer periphery. The first sheet at least partially defines a first shape. A second sheet has a second outer periphery and at least partially defines a second shape. In one embodiment of this invention, at least a portion of the first outer periphery is coextensive with at least a portion of the second outer periphery. The first sheet has a first surface and a second surface opposite the first surface. The second surface of the first sheet can face the second sheet. The second sheet has a first surface facing the first sheet and a second surface opposite the first surface. Preferably, at least a portion of the first surface of the second sheet is adhered to or with respect to at least a portion of the second surface of the first sheet. The first sheet and/or the second sheet may include a transparent or translucent material, such as, for example, a clear vinyl or a clear polyester.

The label further includes a first adhesive positioned between the second sheet and the first sheet and a second adhesive at least partially covering the second surface of the second sheet. When the label is in a mounted position at least partially around an object, the second adhesive contacts the object and the second surface.

Preferably, at least a portion of the first surface of the first sheet is a printable surface. Additionally or alternatively, the label includes a printable coating on at least a portion of the first surface of the first sheet. An image or information in the form of, for example, graphics and/or text, can be printed on the printable surface and/or the printable coating.

In one embodiment of this invention, the first sheet and the second sheet define a front panel, two side panels and two flaps. Each side panel is adjacent an opposing side of the front panel. Each flap is adjacent a side of one of the side panels. Preferably, at least a portion of the front panel is mountable or adherable to at least a portion of a first surface of an object. The remaining portions of the label can be adherable to the same or other surfaces of the object.

The label may further include at least one first void formed within the first shape. The label may also comprise at least one second void formed within the second shape. In one embodiment of this invention, the first void generally corresponds to the second void to form a label opening. The label opening may be used to physically access one or more characteristics of the object, such as, for example, a controller or a control panel.

In one embodiment of this invention, the label includes at least one first removable portion formed within the first sheet and defined by a first line of separation. The label may further comprise at least one second removable portion formed within the second sheet and defined by a second line of separation. In one embodiment of this invention, the first removable portion generally corresponds to the second removable portion. The first void and/or the second void may be formed by removing the first removable portion and/or the second removable portion, respectively.

According to one embodiment of this invention, the customizable label is used for at least partially covering a personal player device having a screen and/or a control panel. The first sheet and the second sheet of the customizable label are dimensioned to cover at least a portion of a first surface of the personal player device. A first removable portion cut within at least one of the first sheet and the second sheet is dimensioned to at least partially overlay the screen of the personal player device. A second removable portion cut within at least one of the first sheet and the second sheet is dimensioned to at least partially overlay the controller or the control panel of the personal player device.

A label assembly according to this invention includes a carrier sheet and label sheets, including a first sheet and a second sheet. The label sheets form at least one removable label portion removably adhered to the carrier sheet.

A method for making a label, according to this invention, includes routing a label assembly, including a carrier sheet, at least one label portion removably adhered to the carrier sheet, a first sheet and a second sheet, through a printer and printing an image on a portion of a printable surface of the label portion. Following printing, the label portion is separated or removed from the carrier sheet. A first removable portion and/or a second removable portion is removed before, after, or as the label portion is separated from the carrier sheet. The label portion, or a part thereof, is positioned with respect to an object so that a first void, a second void and/or a label void are aligned over an area of the object. After proper positioning, at least a portion of a second adhesive is contacted to a surface of the object. At least a portion of the label, such as, for example, a front panel, is adhered to at least a portion of a first surface of the object. The remaining portion of the label is adhered to at least one other surface of the object.

Other objects and advantages of this invention are apparent to those skilled in the art, in view of the following detailed description taken in conjunction with the appended claims and drawings.

BRIEF DESCRIPTION OF THE DRAWINGS

This invention can be better understood with reference to the following drawings. In the drawings, like reference numerals designate corresponding parts throughout the several views. The drawings are not necessarily to scale and emphasis is placed upon clearly illustrating principles of this invention.

DETAILED DESCRIPTION OF PREFERRED EMBODIMENTS

Figure 1:
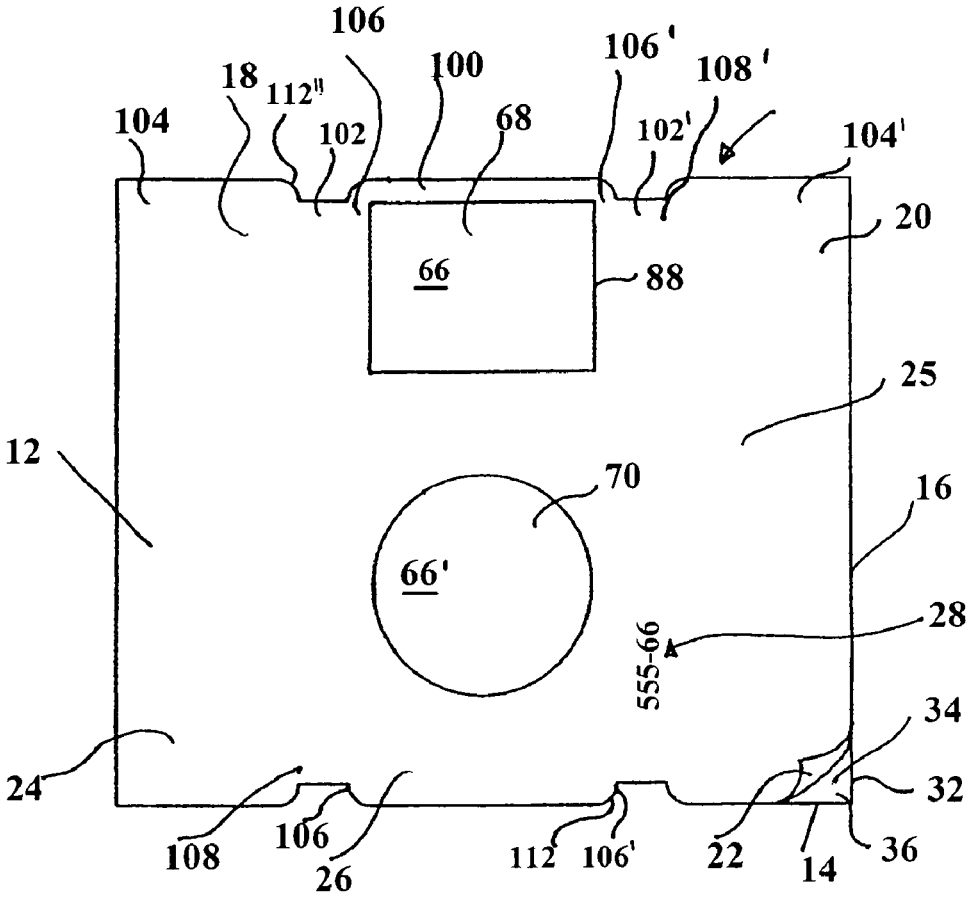
FIG. 1 is a plan view of a label, according to one embodiment of this invention.

FIGS. 1-8 illustrate a label, a label assembly and a method of making a label, according to different embodiments of this invention.

This invention is directed to a label, also referred to as a label portion, having a front surface and a back surface and comprising a first sheet, a second sheet, a first adhesive positioned between the first sheet and the second sheet and a second adhesive at least partially covering the back surface of the label. A first surface of the first sheet forms the front surface of the label and a second surface of the second sheet forms the back surface of the label. The first sheet includes a printable surface upon which an image or information in the form of, for example, graphics and/or text, can be printed. Alternatively or additionally, at least a portion of the first surface of the first sheet includes a printable coating upon which an image or information, such as graphics and/or text, can be printed.

The label defines a front panel, two side panels, each side panel adjacent an opposing side of the front panel, and two flaps, each flap adjacent a side of one of the side panels. Preferably, the front panel of the label is adherable to one surface of an object and the remaining portions of the label are adherable to at least one other surface of the object.

The labels made according to this invention can be positioned about and at least partially adhered, connected or mounted to an object, such as, for example, a personal player, a personal electronic device including, but not limited to, an IPOD™ device, a calculator, a cell phone, an MP3 player, or any other similar or suitable object.

This invention is also directed to a label assembly comprising a carrier sheet and label sheets, including the first sheet and the second sheet, forming at least one label portion removably adhered to the carrier sheet. Each label portion is separable from the carrier sheet. When in a label assembly position, the second sheet of the label portion is adherably positioned or sandwiched between the first sheet and the carrier sheet.

This invention is further directed to a method for making a label, particularly according to this invention. The labels made according to this invention can be routed through a printer to print thereon a choice of an image or information. Such image or information may include a print, a picture, a drawing, a letter, a number, a word and/or a symbol, and/or any other desirable image or information.

Although the following description of this invention generally refers to a label that can be positioned and at least partially adhered, connected, or mounted about a personal electronic device, it is apparent to those skilled in the art that the labels made according to this invention can be used for any suitable or desired purpose.

Referring generally to FIGS. 1-5 and 8, label 10 comprises first sheet 12 and second sheet 14. First sheet 12 has first outer periphery 16 and at least partially defines first shape 18. First sheet 12 includes first surface 20 and second surface 22 opposite first surface 20. First surface 20 forms front surface 24 of label 10 and second surface 22 of first sheet 12 faces second sheet 14. In one embodiment of this invention, second surface 22 of first sheet 12 faces first surface 36 of second sheet 14.

Figure 4:
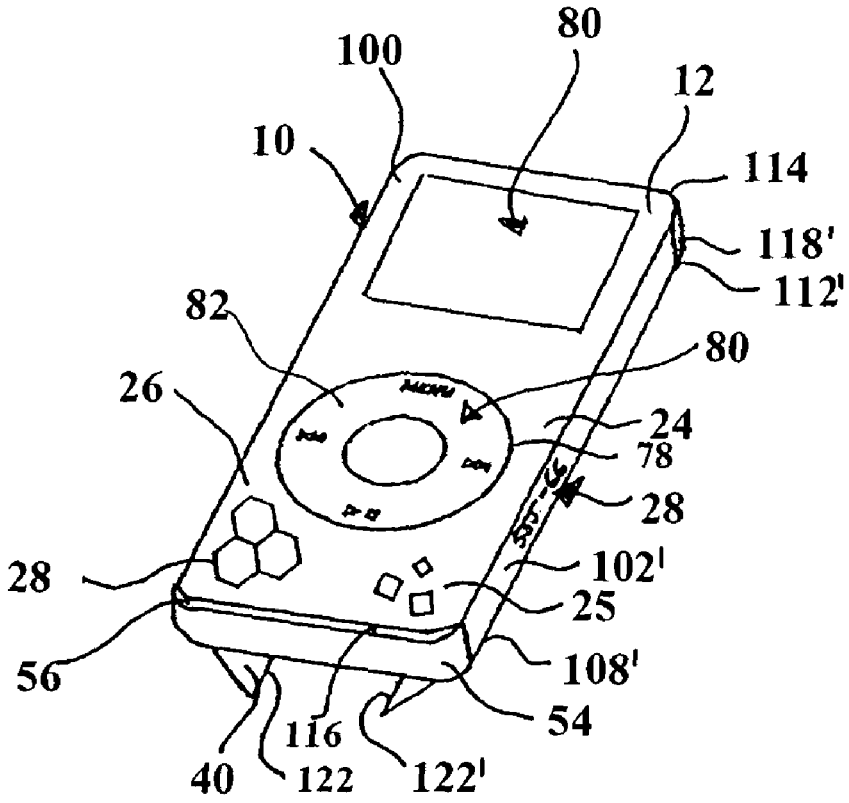
FIG. 4 is a perspective view of a label partially mounted to a player device, according to one embodiment of this invention.

At least a portion of first surface 20 of first sheet 12 includes printable surface 25. Additionally or alternatively, at least a portion of first surface 20 of first sheet 12 includes printable coating 26. Image or information 28 can be printed on at least a portion of printable surface 25 and/or printable coating 26. As used in this specification and in the claims, the terms image or information refer to any suitable or desirable print, photograph, electronic image, such as a digital photograph, a picture, a color, a display drawing, a letter, a text, a number, a word and/or a symbol, and/or any other desirable image or information. For example, the label of this invention adhered to an object may include one or more decorative designs selected by the user and/or selected personal information. FIG. 4 illustrates label 10 according to this invention, displaying image 28 in the form of a decorative design printed on printable surface 25 of first sheet 12.

Printable surface 25 can be any of a variety of face materials used to make pressure sensitive labels, or self-adhesive labels. Such face materials may include, but are not limited to smudgeproof stock, litho stock, cast coated stock, tag stock, fluorescent stock, foils, computer printable polyester, vinyl, satin cloth, TYVEK™ material, flexible plastic, book papers, photo quality papers and/or photo quality film. Further, various portions of the face materials can be different colors, which may result in different colored parts.

As used throughout this specification and in the claims, the term printable surface relates to a surface of any type of matter upon which a person or machine can draw, print, color, paint, photocopy, write, emboss or make any other type of mark or graphic. Laser printers, ink jet printers, impact printers, thermal transfer printers, direct thermal printers, typewriters or any other suitable graphic printing devices are preferred, but not necessary, for use with printable surfaces according to this invention. The printable surface according to this invention can have any suitable shape and/or dimensions in order to print any desired image or information.

Second sheet 14 has second outer periphery 32 and at least partially defines second shape 34. Second sheet 14 includes first surface 36 facing first sheet 12 and second surface 38 opposite first surface 36. Second surface 38 forms back surface 40 of label 10. Back surface 40 of label 10 can be an adhesive side of label 10.

Preferably, but not necessarily, first outer periphery 16 of first sheet 12 is coextensive with second outer periphery 32 of second sheet 14, as shown in FIG. 1. In at least one embodiment of this invention, as shown in FIG. 1, first shape 18 formed by first sheet 12 generally corresponds to second shape 34 formed by second sheet 14.

First sheet 12 and second sheet 14 are preferably, but not necessarily, constructed of any suitable paper material, paper composite, non-metal material, metal material and/or any other suitable material that can be used as a label or as part of a label. Other suitable materials for constructing first sheet 12 and/or second sheet 14 of this invention include fabric, plastic, and metal foils. In one embodiment of this invention, first sheet 12 and/or second sheet 14 comprise polyester. In another embodiment of this invention, first sheet 12 and/or second sheet 14 comprise vinyl.

In one embodiment of this invention, at least a portion of second sheet 14 comprises a transparent material, such as, for example, a clear vinyl and/or a clear polyester. In alternative embodiments of this invention, one or both of first sheet 12 and second sheet 14 can comprise a transparent material or a translucent material. As used throughout this specification and in the claims, the term transparent material or the term translucent material relates to any material that can, at least minimally, be seen through. First sheet 12 and/or second sheet 14 of this invention made of transparent material protects a surface of an object when label 10 of this invention is in a mounted position with respect to the object, while allowing a visual access to at least a portion of the surface of the object.

Label 10 further comprises a layer of first adhesive 42 positioned between second sheet 14 and first sheet 12 such that at least a portion of first sheet 12 is adhered with respect to at least a portion of second sheet 14. One or both of second surface 22 of first sheet 12 and first surface 36 of second sheet 14 can be coated with a layer of first adhesive 42. A coating including first adhesive 42 can be applied to one or both of second surface 22 of first sheet 12 and first surface 36 of second sheet 14 in any suitable manner known to those skilled in the art. In one embodiment of this invention, first adhesive 42 comprises a dry tack adhesive. Alternatively or additionally, any other adhesive known to those skilled in the art may be used for coating second surface 22 of the first sheet 12 and/or first surface 36 of second sheet 14.

Label 10 may comprise second adhesive 44 at least partially covering second surface 38 of second sheet 14. Second adhesive 44 can be positioned between second sheet 14 and carrier sheet 46 so that second adhesive 44 adheres to second sheet 14 exclusively or at least adheres to second sheet 14 more than to carrier sheet 46 when label 10 is removed from or with respect to carrier sheet 46. Carrier sheet 46 preferably, but not necessarily, includes one side 48 having treated surface 50 to facilitate removal of label portion 10 relative to carrier sheet 46. Therefore, at least one side of carrier sheet 46, such as side 48, preferably includes a smooth and/or a release-type surface to ease separation from second surface 38 of second sheet 14 of label portion 10. Second side 52 of carrier sheet 46, opposite treated surface 50 of carrier sheet 46, may be a printable surface or any other suitable surface.

One or both of second surface 38 of second sheet 14 and side 48 of carrier sheet 46 can be coated with second adhesive 44. For example, a coating including second adhesive 44 can be applied to one or both of second sheet 14 and side 48 of carrier sheet 46 in any suitable manner known to those skilled in the art. In one embodiment of this invention, second adhesive 44 comprises an ultra-removable adhesive. In another embodiment of this invention, second adhesive 44 comprises a dispersable adhesive. It is apparent to those skilled in the art that any other suitable adhesive known in the art may alternatively or additionally be used as second adhesive 44 of this invention.

As a result of the above-described configuration, label 10 of this invention comprises first sheet 12 having first surface 20, at least a portion of which comprises printable surface 25 and/or printable coating 26. Label 10 further includes second sheet 14 having first surface 36 adjacent first sheet 12 and at least partially adhered to first sheet 12 by first adhesive 42. Second sheet 14 of label 10 further comprises second surface 38, opposite first surface 36, at least partially coated with second adhesive 44 for contacting surface 56 of object 54 when label is in a mounted, connected or adhered position with respect to object 54.

Label assembly 58 of this invention can include carrier sheet 46 and two label sheets 60 including first sheet 12 and second sheet 14. Second sheet 14 is positioned or sandwiched between first sheet 12 and carrier sheet 46 when label 10 is in a label assembly position. Second sheet 14 is in an adherable contact or communication with both first sheet 12 and carrier sheet 46 when label 10 is in a label assembly configuration. Carrier sheet 46 includes one side 48, which is an adhesive separable side of carrier sheet 46, and second side 52 positioned opposite side 48.

Label 10 further includes at least one first void 66 formed within first shape 18, for example formed by first sheet 12. The at least one first void 66 can be formed as an opening, a cut-out, a removed section, or any other suitable space or disruption in first shape 18. In one embodiment of this invention, as shown in FIG. 1, first sheet 12 includes two voids 66 and 66' formed as first first sheet opening 68 and second first sheet opening 70. First first sheet opening 68 and second first sheet opening 70 can be formed or cut within first shape 18 formed by first sheet 12 of label 10.

Figure 6:
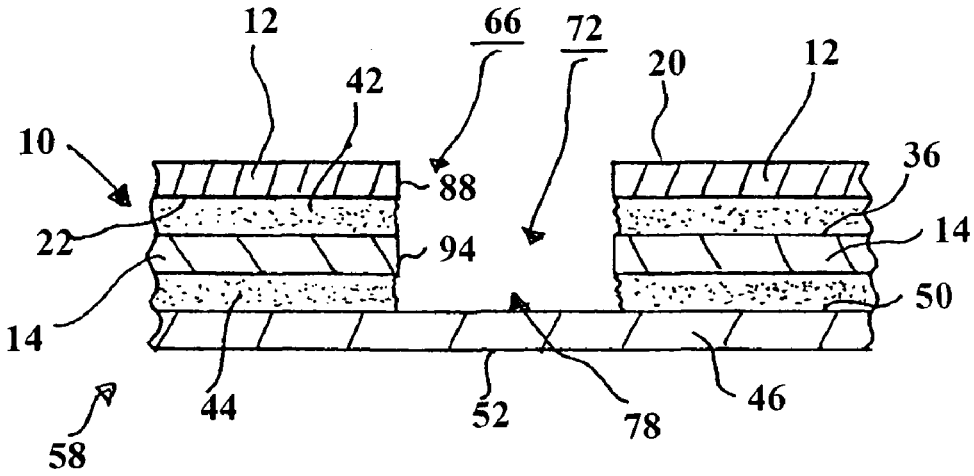
FIG. 6 is a partial sectional view of a label assembly, according to one embodiment of this invention.
Figure 8:
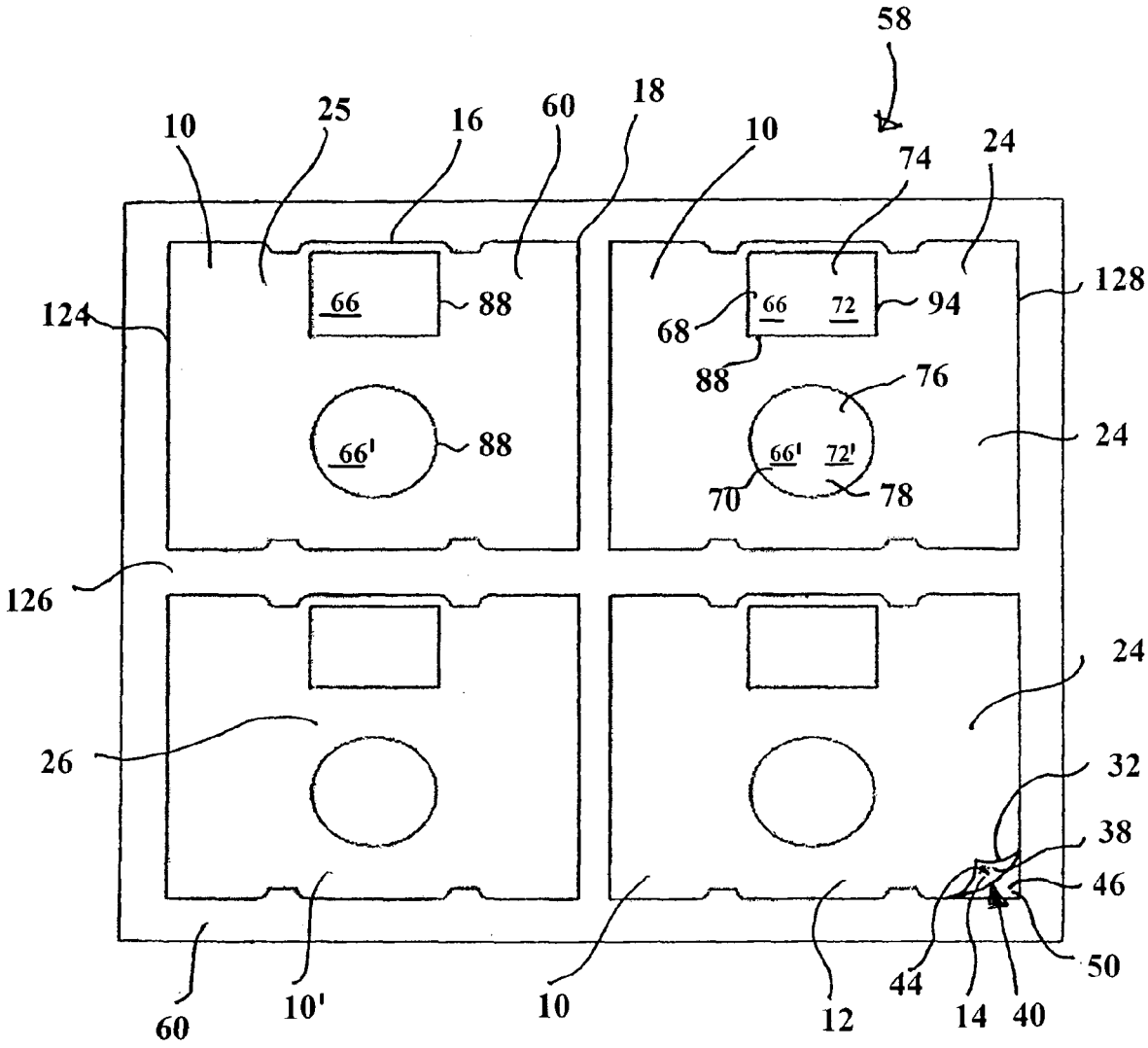
FIG. 8 is a plan view of a label assembly, according to one embodiment of this invention.

In one embodiment of this invention, such as shown in FIG. 6, at least one second void 72 is formed within second shape 34 formed by second sheet 14. The at least one second void 72 can be formed as an opening, a cut-out, a removed section, or any other suitable space or disruption in second shape 34. In one embodiment of this invention, as shown in FIG. 8, second sheet 14 includes two second voids 72 and 72' formed as first second sheet opening 74 and second second sheet opening 76. First second sheet opening 74 and second second sheet opening 76 are formed or cut within second shape 34 formed by second sheet 14 of label 10. At least one of first second sheet opening 74 and second second sheet opening 76 preferably is positioned to correspond to one of first first sheet opening 68 and second first sheet opening 70 formed within first shape 18 formed by first sheet 12.

Figure 7:
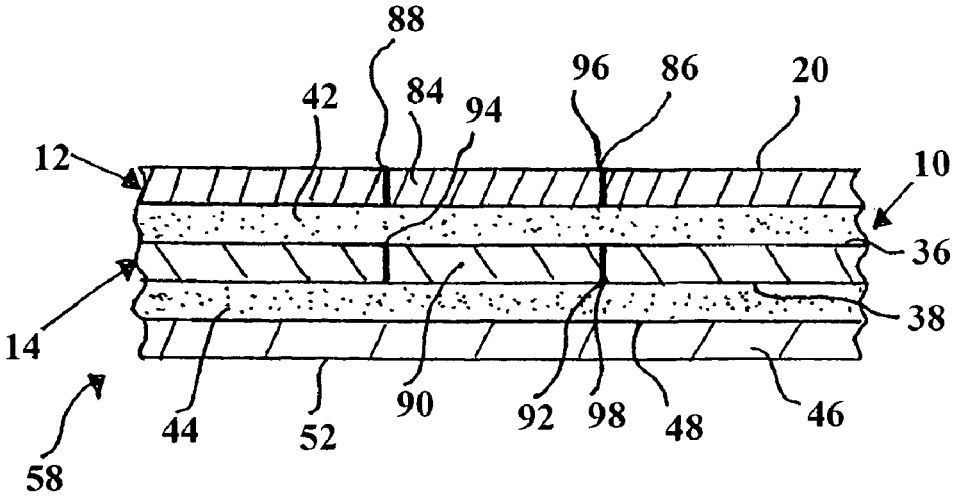
FIG. 7 is a partial sectional view of a label assembly, according to another embodiment of this invention.

Referring generally to FIGS. 6-8, the at least one first void 66 formed within first shape 18 may generally correspond to and/or be generally aligned with the at least one second void 72 formed within second shape 34 such that at least one label void or opening 78 is formed within label 10. Label 10 having at least one first void 66 aligned with at least one second void 72 is positionable around object 54. The at least one label void or opening 78 formed within label portion 10 can be aligned with or over area 80 of object 54. When label 10 of this invention is in a mounted position with respect to surface 56 of object 54, at least one label void or opening 78 formed by corresponding first and second voids 66 and 72, respectively, can be used to access area 80 on surface 56 of object 54. For example, in one embodiment of this invention, as shown in FIG. 4, label void or opening 78 allows access to control panel 82 positioned on surface 56 of object 54. Additionally or alternatively, label void or opening 78 can help slidably position label 10 about a projection (not shown) extending from surface 56 of object 54.

Figure 2:
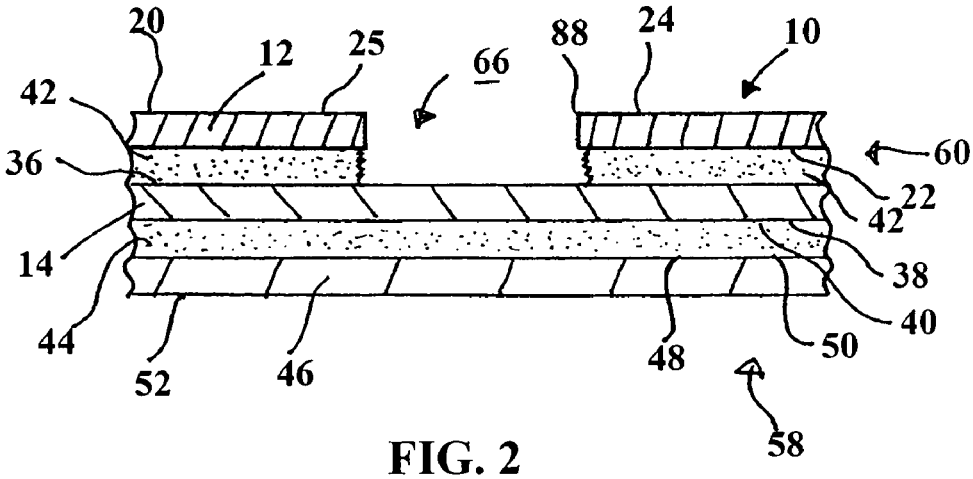
FIG. 2 is a partial sectional view of a label assembly, according to one embodiment of this invention, showing a label portion attached to a carrier sheet.
Figure 3:
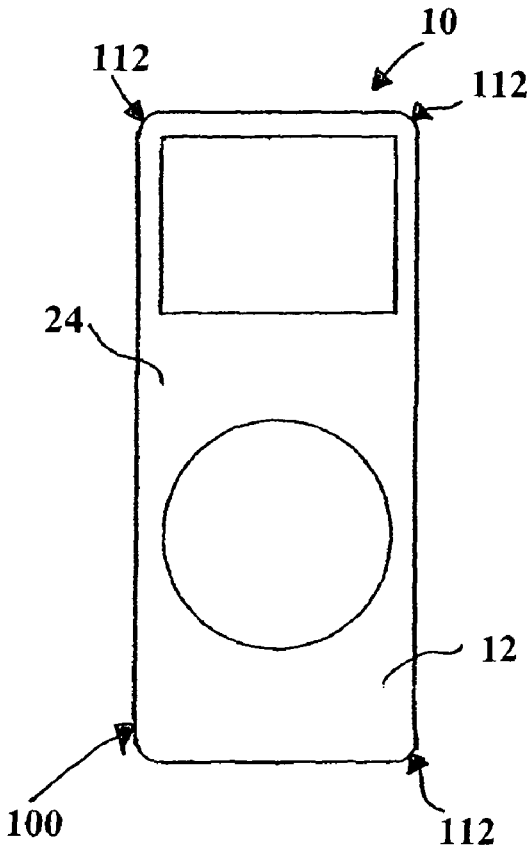
FIG. 3 is a plan view of a front panel of a label, according to one embodiment of this invention.

In one embodiment of this invention, as shown in FIG. 2, label 10 includes at least one first void 66 in first shape 18 of first sheet 12, but label 10 has no second void in second sheet 14. In such embodiment of this invention, at least a portion of second sheet 14 corresponding to the at least one void 66 in first sheet 12 may comprise a translucent or transparent material. In another embodiment of this invention, as shown in FIG. 6, label 10 comprises first void 66 within first shape 18 formed by first sheet 12 and a corresponding second void 72 within second shape 34 formed by second sheet 14. Alternative embodiments of this invention may include labels having any number of corresponding or not corresponding first voids and/or second voids.

In one embodiment of this invention, the at least one first void 66 in first sheet 12 can be formed by removing at least one first removable portion 84 formed or cut within first sheet 12. The at least one first removable portion 84 is removable with respect to first sheet 12 to form the at least one first void 66 within first outer periphery 16 of first sheet 12. An outer periphery or shape 86 of first removable portion 84 can be positioned generally coextensive with or to correspond to a perimeter or shape 88 of first void 66. First removable portion 84, as shown in FIG. 7, can be removed as label portion 10 is removed from carrier sheet 46 and separated from carrier sheet 46. Alternatively, first removable portion 84 can be removed before or after label portion 10 is removed from carrier sheet 46 or separated from carrier sheet 46.

In one embodiment of this invention, the at least one second void 72 in second sheet 14 can be formed by removing at least one second removable portion 90 formed or cut within second sheet 14. The at least one second removable portion 90 is removable with respect to second sheet 14 to form the at least one second void 72 within second outer periphery 32 of second sheet 14. As shown in FIG. 7, an outer periphery or shape 92 of second removable portion 90 can be positioned generally coextensive with or to correspond to a perimeter or shape 94 of second void 72. Second removable portion 90, as shown in FIG. 7, can be removed as label portion 10 is removed from carrier sheet 46 and separated from carrier sheet 46. Alternatively, second removable portion 90 can be removed after label portion 10 is removed from carrier sheet 46 or separated from carrier sheet 46.

In one embodiment of this invention, first removable portion 84 has one of a circular shape, an elliptical shape, a polygonal shape and/or any other suitable non-circular shape, and second removable portion 90 preferably, but not necessarily, has a shape generally corresponding to the shape of first removable portion 84 such that outer periphery 86 of first removable portion 84 is positioned generally coextensive with or to correspond to outer periphery 92 of second removable portion 90. It is apparent to those skilled in the art that each removable portion can have any suitable shape, size and/or dimensions.

First removable portion 84 is preferably defined or formed by first line of separation 96, and second removable portion 90 is preferably defined or formed by second line of separation 98, as shown respectively in FIG. 7. First line of separation 96 preferably extends at least partially along perimeter 88 of first void 66 to define first removable portion 84. Second line of separation 98 preferably extends at least partially along perimeter 94 of second void 72 to define second removable portion 90.

As used throughout this specification and in the claims, the terms lines of separation or separation lines relate to physical or structural lines that can be torn to separate a removable portion or section from the remaining portion or section of the label and/or the label assembly according to this invention. The label portion of this invention may further comprise additional separation lines and/or lines of weakness and/or fold lines to aid in positioning and/or adhering the label around an object. Lines of separation, lines of weakness and/or fold lines according to this invention can be formed of a die-cut line, a laser die-cut line, a score cut line, a perforation line, a micro perforation line, a chemically etched line, a liquid etched line, a gas etched line and combinations thereof, or of any other suitable line along which label 10 and/or any removable portion of label 10 can be separated.

Referring generally to FIGS. 1 and 3-5, label 10 according to one embodiment of this invention defines front panel 100, two side panels 102 and 102' and two flaps 104 and 104'. Side panel 102 is adjacent first side 106 of front panel 100. Side panel 102' is adjacent second side 106' of front panel 100, positioned opposite of first side 106. Flap 104 is adjacent side 108 of side panel 102, positioned opposite of front panel 100. Flap 104' is adjacent side 108' of side panel 102', positioned opposite of front panel 100. Front panel 100, side panels 102 and 102' and flaps 104 and 104' are preferably sized and shaped to fit the dimensions of at least one surface of an object and/or to create a desirable label configuration on the object. Any void and/or opening and/or removable portion within label 10 is similarly sized and shaped to fit around or correspond to at least one characteristic of an object, such as, for example, a control, a control panel, an LCD screen or other monitor, a button, a surface projection and/or other characteristics of an object.

Figure 5:
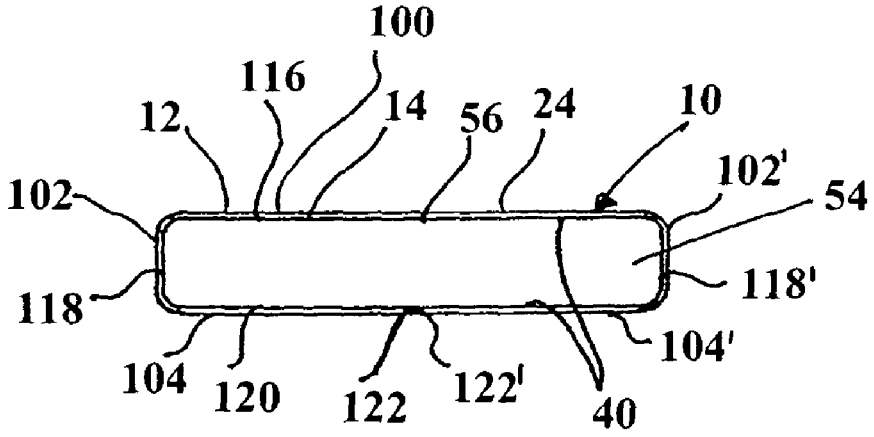
FIG. 5 is a side view of a label mounted to a player device, according to another embodiment of this invention.

In one embodiment of this invention, as shown in FIGS. 4 and 5, label portion 10 is sized and shaped to fit around and at least partially adhere to object 54, which, for example, can be any suitable digital media player, digital music player, MP3 player, and/or any other personal device. In one embodiment of this invention, each of front panel 100, side panels 102 and 102' and flaps 104 and 104' comprises a generally rectangular shape. One or more corners 112, 112' and/or 112" of the generally rectangular front panel 100, side panels 102 and 102' and flaps 104 and 104' can be rounded or otherwise shaped to better fit one or more surfaces of object 54. Preferably, but not necessarily, at least a portion of first outer periphery 16 of first sheet 12 and at least a portion of second outer periphery 32 of second sheet 14 are flush with at least a portion of edge 114 of surface 56 of object 54.

In one embodiment of this invention, the front panel has a generally rectangular shape with dimensions of about 40 millimeters by about 90 millimeters. The first void within the first sheet of the label has a generally rectangular shape with dimensions of about 22 millimeters by about 30 millimeters. Another first void within the first sheet of the label has a generally circular shape having a diameter of about 30 millimeters. The second sheet may include one or more corresponding second voids within the second sheet. Each of the two side panels has a generally rectangular shape having a width of about 7 millimeters and a length shorter than about 90 millimeters. Each of the two flaps has a length of about 90 millimeters.

Label 10 according to this invention, as shown in FIGS. 4 and 5, is at least partially trappable or position able around object 54, and at least a portion of label 10 is adherable to at least one surface of object 54. FIG. 4 shows label 10 according to this invention partially wrapped around and adhered to object 54. In a mounted position, at least a portion of front panel 100 is adhered to front surface 116 of object 54. At least a portion of side panel 102 and 102' is adhered to side surface118 and 118', respectively, of object 54. At least a portion of flap 104 and 104' is adhered to back surface 120 of object 54. In one embodiment of this invention, as shown in FIG. 5, label 10 is sized to fit snugly about or around object 54, when label 10 is in a mounted position, so that outside edge 122 of flap 104 is flush with outside edge 122' of flap 104'. In such configuration, no substantial gap is formed between outside edge 122 of flap 104 and outside edge 122' of flap 104'. In other and alternative embodiments of this invention, flaps 104 and 104' can overlap or a gap can be formed between outside edge 122 of flap 104 and outside edge 122' of flap 104' when label 10 is in a mounted position on object 54.

It is apparent to those skilled in the art that the label and/or portions of the label, according to this invention, can have any suitable shape and/or size that results in a desired placement of the label on an object.

FIG. 8 illustrates label assembly 58, according to one embodiment of this invention. Referring generally to FIG. 8, label assembly 58 is of any suitable shape, and generally any suitable size that can be accepted by and fed through a printer, such as a laser printer or an ink jet printer. Common sizes of paper generally fed through printers include, but are not limited to, 8.5 inches by 5.5 inches, 8.5 inches by 11 inches, 8.263 inches by 11.688 inches (A4 size), and 8.5 inches by 14 inches. Label assembly 58 preferably includes carrier sheet 46 and at least one label portion 10 with a layer of second adhesive 44 between carrier sheet 46 and label portion 10.

Label assembly 58 includes carrier sheet 46 and two label sheets 60, including first sheet 12 and second sheet 14. Label sheets 60 form or define at least one label portion 10. In one embodiment of this invention, label assembly 58 includes a plurality of label portions 10, such as shown in FIG. 8. Label portion 10 is preferably pre-cut or shaped into a desired form for application in a desired manner, such as, for example, for mounting, connecting or adhering to a surface of object 54. At least one label line of separation 124 is formed between label portion 10 and remaining portion 126 of label sheets 60 to define label outer periphery 128 of each label portion 10. Preferably, label line of separation 124 is die-cut along at least a portion of first outer periphery 16 of first sheet 12 of label portion 10 and/or at least a portion of second outer periphery 32 of second sheet 14 of label portion 10. In one embodiment of this invention, label line of separation 124 is generally coextensive with first outer periphery 16 of first sheet 12 and second outer periphery 32 of second sheet 14. Label portion 10 is removable from carrier sheet 46 and removable with respect to remaining portion 126 of label sheets 60 and/or one other label portion 10' on label assembly 58.

After label portion 10 is removed from carrier sheet 46, second adhesive 44 at least partially covers back surface 40 of label portion 10 so that back surface 40 of label portion 10 can be adhesively bonded to at least one surface of an object. At least a portion of second adhesive 44 is contactable to or with a surface of object 54.

Carrier sheet 46 of label assembly 58 preferably includes one side 48 having treated surface 50 to facilitate removal of label portion 10 relative to carrier sheet 46. More specifically, the removal of label portion 10 from carrier sheet 46 is facilitated by treated surface 50. Preferably, a substantial portion of the layer of second adhesive 44 remains with label portion 10 as it is removed from carrier sheet 46. As shown in FIG. 8, in one embodiment of this invention, carrier sheet 46 of label assembly 58 is preferably generally coextensive with label sheets 60. FIG. 8 shows a portion of carrier sheet 46 with a portion of one label portion 10 peeled away from carrier sheet 46.

In making label 10 according to one embodiment of this invention, label assembly 58, including carrier sheet 46 and at least one label portion 10, is routed through a suitable printer. Information or image 28 is printed on at least a portion of printable surface 25 of first sheet 12. Alternatively or additionally, information or image 28 is printed on at least a portion of printable coating 26 of label 10.

After label assembly 58 is routed through the printer to print on label 10 the desired or selected information or an image, label 10 is separated from carrier sheet 46 along label line of separation 124 formed between label portion 10 and remaining portion 126 of label sheets 60. Label 10 is removed from carrier sheet 46 with second adhesive 44 initially positioned between carrier sheet 46 and label portion 10 adhering substantially to back surface 40 of label 10. Thus, the coating of second adhesive 44 at least partially covers back surface 40 of label 10 after label 10 is removed from carrier sheet 46. When label 10 is separated from carrier sheet 46, the coating of second adhesive 44 is exposed for contacting with a surface of an object.

As label 10 is removed from carrier sheet 46, first removable portion 84, if any, is removed from first sheet 12 to form first void 66. As label 10 is removed from carrier sheet 46, second removable portion 90, if any, is removed from second sheet 14 to form second void 72. In certain embodiments of this invention, first removable portion 84 and/or second removable portion 90 can be removed from label 10 before or after label 10 is removed from carrier sheet 46. In other embodiments of this invention, first removable portion 84 and second removable portion 90 can be removed separately or, alternatively, as a unit from carrier sheet 46.

After label portion 10 is removed from label assembly 58, back surface 40 of label 10 can be adhesively bonded or adhered to at least one surface of an object by contacting back surface 40 of label 10 to the surface of the object and applying pressure to front surface 24 of label 10 to properly adhere label 10 to the surface of the object. Before label 10, or any part thereof, is adhered to an object, label 10, or any part thereof, is preferably positioned around or near the object in a desired configuration. Any voids and/or openings within first sheet 12 and/or second sheet 14 are preferably positioned and/or aligned over one or more areas of the object. After proper positioning, label 10 is adhered to the object.

In one embodiment of this invention, front panel 100 of label 10 is preferably at least partially adhered to a first surface of an object and the remaining portions of label 10 are preferably adhered to at least one other surface of the object. In one embodiment of this invention, front panel, or a portion thereof, is adhered first to a first surface of an object and the remaining portions of label 10 are subsequently adhered to the same or other surfaces of the object. In certain embodiments of this invention, a selected portion of the label, such as, for example, a front panel, a side panel or a flap, can be adhered to a surface of an object first, before adhering the remaining portions of the label, so that a proper and/or more convenient placement of the label on or around the object can be achieved.

While in the foregoing specification this invention has been described in relation to certain embodiments thereof, and many details have been set forth for purpose of illustration, it will become apparent to those skilled in the art that this invention is susceptible to additional embodiments and that certain of the details described herein can be varied considerably without departing from the basic principles of the invention. Therefore, to particularly point out and distinctly claim the subject matter regarded as the invention, the following claims conclude the specification.

We claim:

1. A label for at least partially covering an object, the label comprising:

a label assembly comprising a first sheet including a printable surface, a second sheet formed of a transparent material, a carrier sheet including a release surface, a first adhesive layer between and adhering the first sheet and the second sheet, and a second adhesive layer between and adhering the second sheet to the release surface of the carrier sheet, each of the first sheet, the second sheet, the carrier sheet, the first adhesive layer, and the second adhesive layer having at least substantially coextensive outer peripheries;

a label shape formed at an outer periphery by a first tearable line of separation extending through the first sheet and the second sheet, the label shape removably adhered to the carrier sheet and surrounded by a remaining portion of the label assembly, the label shape including a portion of the first sheet defined at the outer periphery by the first tearable line of separation, and the label shape including a portion of the second sheet defined at the outer periphery by the first tearable line of separation;

a first removable portion defined within the outer periphery of the label shape by a second line of separation cut within the first sheet only, and removable from the label shape to expose the transparent second sheet there beneath;

a second removable portion defined within the outer periphery of the label shape by a third line of separation cut within both the first sheet and the second sheet, and removable from the label shape to create a void extending through the portion of each of the first sheet and second sheet.

2. The label of claim 1, wherein each of the first sheet and the second sheet is formed of polyester or vinyl.

3. The label of claim 1, wherein the label shape comprises a lateral side portion to wrap at least partially around the object when in a mounted position with the second adhesive contacting the object.

4. The label of claim 3, wherein the second portion has a length that is less than a length of the first portion, and the first portion comprises rounded corners adjacent the second portion.

5. The label of claim 1, wherein the label shape comprises a first portion for a front panel of the object and further comprises a second portion extending from a side of the first portion coextensively in each of the first sheet and the second sheet for wrapping around at least a side portion of the object.

6. The label of claim 1, wherein the first removable portion has at least a substantially polygonal shape.

7. The label of claim 6, wherein the second removable portion has at least a substantially circular or elliptical shape.

8. A label for at least partially covering a personal electronic device having a screen and a control element, the label comprising:

a label assembly comprising as at least substantially coextensive layers a polyester or vinyl first sheet including a printable surface, a carrier sheet including a release surface, a polyester or vinyl transparent second sheet between the first sheet and the carrier sheet, a first adhesive layer between and adhering the first sheet and the second sheet, and a second adhesive layer between and adhering the second sheet and the carrier sheet;

a label shape formed at an outer periphery by a first tearable line of separation extending through the first sheet and the second sheet, the label shape removable from a remaining portion of the label assembly that extends around the outer periphery of the label shape and from the release surface of the carrier sheet, the label shape including a first sheet portion defined in the first sheet by the first tearable line of separation, and the label shape including a second sheet portion coextensive with the first sheet portion and defined in the second sheet by the first tearable line of separation;

a first removable portion at a first position within the outer periphery of the label shape and defined by a second tearable line of separation in the first sheet and not extending into the second sheet, the first removable portion having a size corresponding to a size of the screen of the personal electronic device, the first removable portion removable to expose a portion of the transparent second sheet there beneath, wherein the adhesive layer on a side of the transparent second sheet that is opposite the first removable portion is adherable to the screen of the personal electronic device;

a second removable portion at a second position within the outer periphery of the label shape and having a size corresponding to a size of the control element of the personal electronic device, the second removable portion defined by a third tearable line of separation cut through both the first sheet and the second sheet and removable to create a void extending through each of the first sheet and second sheet.

9. The label of claim 8, wherein the label shape comprises a first portion for a front panel of the object, the first portion including the second removable portion and the first removable portion, and the label portion further comprising a second portion laterally extending from a side of the first portion coextensively in each of the first sheet and second sheet for wrapping around at least a side portion of the object.

10. The label of claim 9, wherein the second portion has a length that is less than a length of the first portion, and the first portion comprises rounded corners adjacent the second portion.

11. The label of claim 8, wherein the first removable portion has at least a substantially polygonal shape and the second removable portion has at least a substantially circular or elliptical shape.

12. A method for labeling a personal electronic device having a screen and a control element, the method comprising:

routing a label assembly through a printer, the label assembly including as at least substantially coextensive layers a first sheet including a printable surface, a carrier sheet including a release surface, a transparent second sheet between the first sheet and the carrier sheet, an adhesive layer between the second sheet and each of the first sheet and the carrier sheet, and a label shape defined at an outer periphery by a tearable line of separation cut through the first sheet and the second sheet;

printing on the printable surface of the first sheet within the outer periphery of the label shape with the printer;

removing the printed label shape from the label assembly by separating the label portion from a remaining portion of the label assembly and lifting the label portion from the carrier sheet;

removing a first removable portion from the label shape to expose the transparent second sheet beneath the first removable portion, the first removable portion defined by a second tearable line of separation cut in only the first sheet of the label shape;

removing a second removable portion defined by a third tearable line of separation cut within the first sheet and the second sheet of the label shape to create a void extending through the label shape;

aligning the label shape over the personal electronic device with the exposed transparent second sheet over the screen of the object and the void over the control element of the personal electronic device; and adhering the label shape to the personal electronic device.

13. The method of claim 12, further comprising wrapping a portion of the label shape around a side of the personal electronic device.

* * * * *